US006315644B1

(12) United States Patent
Cho et al.

(10) Patent No.: US 6,315,644 B1
(45) Date of Patent: Nov. 13, 2001

(54) APPARATUS AND PROCESS FOR SUPPLYING ABRASIVES FOR USE IN THE MANUFACTURE OF SEMICONDUCTORS

(75) Inventors: Toshitsura Cho; Akira Iwashiro, both of Kawasaki (JP)

(73) Assignee: Tama Chemicals Co., Ltd., Kanagawa (JP)

( * ) Notice: Subject to any disclaimer, the term of this patent is extended or adjusted under 35 U.S.C. 154(b) by 0 days.

(21) Appl. No.: 09/444,451

(22) Filed: Nov. 22, 1999

(30) Foreign Application Priority Data

Apr. 1, 1999 (JP) ..... 11-095411

(51) Int. Cl.[7] ..... B24B 1/00

(52) U.S. Cl. ..... 451/60; 451/165; 451/41; 451/289; 451/102; 451/99; 366/114

(58) Field of Search ..... 451/165, 41, 289, 451/102, 99; 366/114

(56) References Cited

U.S. PATENT DOCUMENTS 5,522,760 * 6/1996 Patel et al. ..... 451/75
5,641,228 * 6/1997 Prokopenko ..... 366/114
6,024,829 * 2/2000 Easter et al. ..... 156/345

* cited by examiner

*Primary Examiner*—Derris H. Banks
*Assistant Examiner*—Shantese McDonald
(74) *Attorney, Agent, or Firm*—Birch, Stewart, Kolasch & Birch, LLP

(57) ABSTRACT

An apparatus of this invention for supplying an abrasive for use in the manufacture of semiconductors comprises a storage tank of the abrasive and a supply line for guiding the abrasive from the storage tank to a nozzle for supplying the abrasive to an object to be polished and said storage tank or supply line is provided with a device for furnishing ultrasonic wave to sonicate the abrasive. A process of this invention for supplying an abrasive for use in the manufacture of semiconductors comprises sonicating the abrasive by ultrasonic wave before supplying it to an object to be polished. The apparatus and process of this invention for supplying an abrasive for use in the manufacture of semiconductors make it possible to supply an abrasive containing a minimized amount of abnormally agglomerated particles to the surface of an object to be polished in the manufacturing step of semiconductors and improve the yield of polished products.

13 Claims, 6 Drawing Sheets

APPARATUS AND PROCESS FOR SUPPLYING ABRASIVES FOR USE IN THE MANUFACTURE OF SEMICONDUCTORS

FIELD OF THE INVENTION AND RELATED ART STATEMENT

This invention relates to an apparatus and a process for supplying an abrasive to an apparatus for polishing the surface of an object to be polished or workpiece such as wafer to be used as substrate or wafer coated with an insulation membrane or metal membrane to be treated by CMP (chemical and mechanical polishing) in the manufacture of semiconductors.

An advance in the LSI technology has rapidly generated a tendency toward device miniaturization and multi-level wiring in semiconductor integrated circuit. Multi-level wiring in integrated circuit has caused an extremely large increase in unevenness of the surface of semiconductors. In the manufacture of semiconductors, such steps as the manufacture of wafers for semiconductor use and the manufacture of semiconductor integrated circuits by printing circuits on wafers require a planarization technique for flattening the wafers to be used as substrate, the insulation membranes and metal membranes covering a part of the circuits printed on the wafers, and metal wirings. In particular, CMP is available as one of such planarization techniques applicable to an insulation membrane or metal membrane covering a part of the circuit on a wafer or to metal wiring. For example, the CMP technique is applied with the use of an apparatus for polishing the surface of interlayer insulation membranes and oxidation membranes for trench use ($SiO_2$) with abrasives, an apparatus for polishing metal wirings and metal membranes (W, Al, Cu) with abrasives, or an apparatus for polishing polysilicon for use in trench and gate electrode with abrasives.

Abrasives useful for polishing the aforementioned workpiece are usually dispersions of abrasive particles based on silica (precipitated silica, fumed silica, colloidal silica, synthetic silica, etc.), alumina, cerium oxide, and zirconia in a variety of dispersion media, the choice depending on the kind of workpiece, the stage of use in the manufacture of semiconductors, and the polishing performance.

In order to polish the surface of workpiece with precision to a specified level, it is extremely important for the abrasive particles to be dispersed homogeneously and stably in a dispersion medium. To satisfy this requirement, a variety of dispersion media have been worked out by adding a third component to a base; for example, a dispersion medium for silica-based abrasive particles was devised by adding a surfactant to an aqueous solution of an electrolyte such as KOH and $NH_4OH$ and another dispersion medium for alumina-based abrasive particles by adding a surfactant or oxidizing agent to an aqueous solution of $H_2O_2$.

Abrasive particles to be used for polishing the workpiece in the manufacture of semiconductors, however, are extremely fine in the range from 0.01 to 50 $\mu$m and adjusted to have an extremely rigid particle size distribution. A delicate change in the chemical composition of dispersion medium as a result of evaporation while the container is opened in use, a change in temperature during storage of the abrasives, and other factors cause abrasive particles to undergo agglomeration with ease to form abnormally agglomerated particles of a large diameter in excess of a specified range of particle size distribution.

Such abnormally agglomerated particles, when formed in the abrasive, affect the polishing performance against the workpiece to such an extent as to change the polishing speed and cause damages such as scratches on the surface of the workpiece. As a result, they give polished products of inferior quality and lower the yield of acceptable products.

To deal with the case such as the aforementioned, a conceivable procedure would be to remove those particles which are larger than the standard particle diameter (that is, abnormally agglomerated particles and foreign particles) by filtration immediately before the abrasive is put to use. This procedure of filtering the abrasive immediately before use would be desirable as it is able to remove particles larger than the standard diameter with certainty and prevent the generation of polished products of inferior quality as much as possible. In practice, however, the filter clogs in a short time of use and needs to be replaced frequently, which makes it difficult to apply filtration on a commercial scale.

Now, the formation of abnormally agglomerated particles cannot be confirmed unless the surface condition of the product coming out of the polishing step is examined and judged and, moreover, the evaluation of whether the abrasive particles satisfy the standard particle diameter or not immediately before use of the abrasive is unrealistic costwise on a commerical scale.

Still more, it is desirable from the viewpoint of minimizing the manufacturing and transportation cost to prepare abrasives in high concentration and dilute to a specified concentration at time of use. However, agglomeration tends to occur more easily as the concentration becomes higher and, under the present conditions, the reduction of cost by this approach is difficult to accomplish.

OBJECT AND SUMMARY OF THE INVENTION

The present inventors have conducted studies to solve the aforementioned problems relating to abrasives, found surprisingly that an abrasive in which abnormally agglomerated particles have formed after preparation is sonicated by ultrasonic wave thereby nearly selectively deagglomerating the abnormally agglomerated particles without affecting the average particle diameter and particle size distribution of the abrasive particles obtained at the time of preparation (abrasive particles before agglomeration) and restoring the abrasive to have roughly the same average particle diameter and particle size distribution obtained at the time of preparation, and completed this invention.

Accordingly, an object of this invention is to provide an apparatus for supplying an abrasive for use in the manufacture of semiconductors which is capable of supplying an abrasive containing as little as possible of abnormally agglomerated particles to the surface of the workpiece and improving the yield of polished products in the manufacture of semiconductors.

Another object of this invention is to provide a process for supplying an abrasive for use in the manufacture of semiconductors which is capable of supplying an abrasive containing as little as possible of abnormally agglomerated particles to the surface of the workpiece and improving the yield of polished products in the manufacture of semiconductors.

Thus, this invention relates to an apparatus for supplying an abrasive for use in the manufacture of semiconductors comprising a storage tank which stores an abrasive for use in the manufacture of semiconductors and a supply line which guides the abrasive from the storage tank to a nozzle for supplying the abrasive to the workpiece, with a device for furnishing ultrasonic wave provided on the aforementioned storage tank or supply line for the purpose of sonicating the abrasive.

Furthermore, this invention relates to a process for supplying an abrasive for use in the manufacture of semiconductors wherein the abrasive is sonicated by ultrasonic wave before it is supplied to the workpiece.

An abrasive to which this invention is applicable is a dispersion in a specified dispersion medium of extremely fine abrasive particles which are used in surface polishing of the workpiece in the manufacturing step of semiconductors and are normally in the range from 0.01 to 50 $\mu$m and, hence, it is composed of abrasive particles and a dispersion medium. Such abrasive may be prepared in a composition either with a concentration applicable as prepared to the polishing of the workpiece or with a high concentration requiring proper dilution immediately before use.

There is no specific restriction to abrasive particles constituting the abrasive and the following known particles may be cited as examples; silica-based particles such as precipitated silica, fumed silica, colloidal silica and synthetic silica, alumina-based particles, cerium oxide-based particles, and zirconia-based particles. Also, there is no specific restriction to the dispersion medium and examples include such known dispersion media as those based on aqueous KOH, $NH_4OH$ and other electrolytes or on aqueous $H_2O_2$ and those prepared by adding a third component such as a surfactant to the foregoing aqueous solutions.

It is essential that an apparatus for supplying an abrasive in accordance with this invention contains at least a storage tank for the abrasive, a nozzle for ejecting the abrasive to a polishing disk, and a supply line which guides the abrasive from the aforementioned storage tank to the nozzle and there are no other restrictions. The storage tank may consist of one tank or of two or more tanks placed in series and/or in parallel. The storage tank may be provided with agitating elements for agitating the abrasive and, in addition, with a circulation system consisting of a circulating line and a pump.

In this invention, a device for furnishing ultrasonic wave for sonicating the abrasive is provided on the aforementioned storage tank or supply line. The abrasive is sonicated before it is supplied to the workpiece and this effects deagglomeration of the abnormally agglomerated particles in the abrasive. Deagglomeration here refers to decomposition of partially agglomerated particles in the abrasive into the original particles while restoring roughly the same average particle diameter and particle size distribution obtained at the time of preparation of the abrasive.

A device for furnishing ultrasonic wave to be used in this invention is free of any other restrictions as long as it can be provided on the storage tank of the abrasive and/or the supply line guiding the abrasive to the nozzle above the polishing disk. The device in question may be an immersion type ultrasonic wave generator which is immersed in the abrasive for direct sonication of the abrasive, an installation type ultrasonic wave generator which is installed underneath the bottom wall or outside the side wall of the storage tank for indirect sonication of the abrasive through the wall of the storage tank, or a fixed type ultrasonic wave generator which is fixed outside the supply line for indirect sonication of the abrasive through the supply line. An appropriate number of ultrasonic wave generators may be placed at appropriate locations without any specific restrictions. One ultrasonic wave generator is normally sufficient for one storage tank, but one generator each may be provided for the receiving storage tank, the receiving line and the supply line depending upon the capacity of the storage tank and the amount of the abrasive to be used.

The frequency of the ultrasonic wave to sonicate the abrasive by means of the aforementioned device for furnishing ultrasonic wave is selected according to the composition, particularly the average particle size, of the abrasive and normally ranges from 19 kHz to 2 MHz, preferably from 20 to 100 kHz. The deagglomeration of abnormally agglomerated particles takes more time with a frequency lower than 19 kHz while the deagglomeration becomes difficult to effect with a frequency higher than 2 MHz.

There is no specific way for sonicating the abrasive by the aforementioned device for furnishing ultrasonic wave and ultrasonic wave may be applied at all times, only while the apparatus for supplying the abrasive is at work, or intermittently at specified time interval.

According to this invention, the abnormally agglomerated particles in the abrasive are deagglomerated as much as possible and the abrasive is restored to have roughly the average particle diameter and particle size distribution obtained at the time of preparation. Therefore, a filter placed for removal of particles larger than the standard particle diameter between the device for furnishing ultrasonic wave and the nozzle can remove larger-than-standard particles such as the residual abnormally agglomerated particles and foreign particles inevitably entering from outside and improve the yield of polished products and extend the service life of the filter.

In consequence, even when an abrasive for use in the manufacture of semiconductors contains abnormally agglomerated particles larger than the standard particle diameter, such abrasive can be brought to a condition where the quantity of abnormally agglomerated particles is reduced as much as possible and then supplied to the surface of the workpiece to improve the yield of the polished products.

DETAILED DESCRIPTION OF THE PREFERRED EMBODIMENTS

A preferred mode of execution of this invention will be described below with reference to the accompanied drawings.

Figure 1:
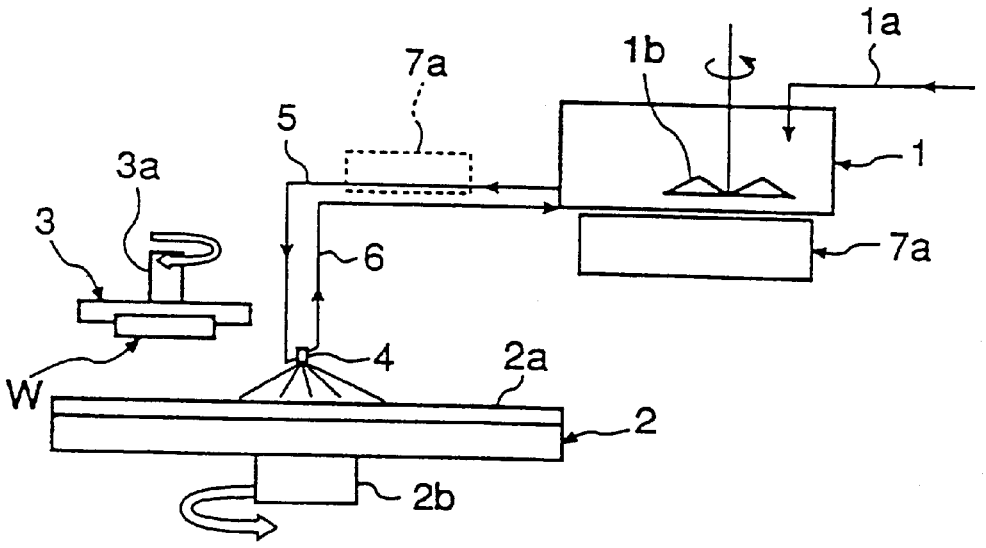
FIG. 1 is a drawing of a chemical and mechanical polishing apparatus (CMP apparatus) to which an apparatus for supplying the abrasive relating to the first mode of execution of this invention is applied.

FIG. 1 is a conceptual drawing of an apparatus for chemical and mechanical polishing (CMP apparatus) to which an apparatus for supplying an abrasive relating to the first mode of execution of this invention is applied. Fundamentally, the apparatus is composed of the transfer line 1*a* which introduces the abrasive of a specified composition, the storage tank 1 for the abrasive equipped with an agitating element 1*b,* the polishing disk 2 which has the polishing cloth 2*a* pasted on the upper surface and the rotating device 2*b* at the bottom, the pressing head 3 which has the rotating device 3*a* moving in opposite direction to that of the polishing disk 2, holds the workpiece or the semiconductor wafer W, and presses the wafer W against the polishing cloth 2*a,* the nozzle 4 which is placed above the aforementioned abrading disk 2 and supplies the abrasive to the specified location on the polishing cloth 2*a,* the supply line 5 which supplies the abrasive from the aforementioned storage tank 1 to the nozzle 4, and the circulating line 6 which returns the abrasive not supplied to the abrading cloth 2*a* from the nozzle 4 to the storage tank 1.

In the aforementioned first mode of execution, the ultrasonic wave generator 7*a* is provided underneath the bottom wall of the aforementioned storage tank 1 and the abrasive stored in the storage tank 1 is sonicated by ultrasonic wave of a given frequency indirectly through the bottom wall of the storage tank 1 before it is supplied to the polishing cloth 2*a* on the polishing disk 2.

Thus, in the first mode of execution, the ultrasonic wave generator 7*a* is provided underneath the bottom wall of the storage tank 1 for indirect sonication of the abrasive, but the placing of the ultrasonic wave generator 7*a* is not limited to this particular location. The ultrasonic wave generator 7*a* may be provided outside the side wall of the storage tank 1 or it may be provided on the supply line 5 for indirect sonication of the abrasive flowing through the supply line 5. Moreover, the ultrasonic wave generator 7*a* may be provide in plural underneath the bottom wall or outside the side wall of the storage tank 1 or on the supply line 5.

Figure 2:
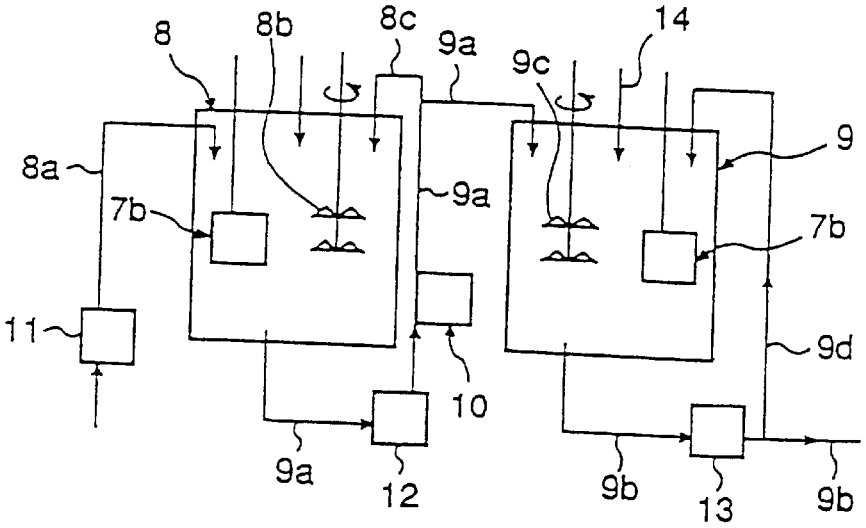
FIG. 2 is a drawing of an apparatus for preparing the abrasive to which an apparatus for supplying the abrasive relating to the second mode of execution of this invention is applied.

FIG. 2 illustrates an apparatus for preparing an abrasive with application of an apparatus for supplying an abrasive relating to the second mode of execution of this invention and it is used, as needed, for purposes such as preparation, formulation, dilution, storage, and supply of the abrasive. The apparatus in question may be coupled to a supply line to the polishing apparatus in order to effect direct supply of the abrasive to the polishing apparatus or, if necessary, it may be used as an apparatus for supplying the abrasive to the storage tank 1 of the CMP apparatus shown in FIG. 1.

In the aforementioned second mode of execution, the apparatus for preparing an abrasive is composed of the mixing tank 8 which receives the abrasive of high concentration from the receiving line 8*a* and agitates by circulation, the diluting tank 9 which receives the abrasive of high concentration withdrawn from the mixing tank 8, dilutes with pure water, and supplies the abrasive of adjusted concentration to a polishing apparatus (not shown) via the supply line 9*b,* and the filter 10 which is provided on the transfer line 9*a* between the mixing tank 8 and the diluting tank 9 and removes particles larger than the standard diameter (abnormally agglomerated particles and foreign particles) present in the abrasive circulating in the mixing tank 8 or moving from the mixing tank 8 to the diluting tank 9. Agitating elements 8*b* and 9*c* are provided respectively in the aforementioned mixing tank 8 and diluting tank 9 and, in addition, circulating lines 8*c* and 9*c* are provided for circulating the abrasive in the tanks. The pumps 11, 12, and 13 are provided for the receiving line 8*a,* the transfer line 9*a,* and the supply line 9*b.* The pure water supply line 14 is provided for supplying pure water.

In the second mode of execution, the ultrasonic wave generator 7*b* is provided inside the aforementioned mixing tank 8 and diluting tank 9 and is capable of directly sonicating the abrasive by ultrasonic wave of a given frequency before the abrasive is supplied to the polishing apparatus.

In the second mode of execution, the ultrasonic wave generator 7*b* is provided inside the mixing tank 8 and diluting tank 9 for direct sonication of the abrasive, but the placing of the ultrasonic wave generator is not limited to this particular location. An ultrasonic wave generator (not shown) may be provided underneath the bottom wall or outside the side wall of the mixing tank 8 and diluting tank 9 or on the transfer line 9*a* and the supply line 9*b* for indirect sonication of the abrasive. Furthermore, the ultrasonic wave generator 7*b* for direct sonication and an ultrasonic wave generator for indirect sonication may be provided in proper combination.

As the aforementioned first and second modes of execution indicate, during the supply of the abrasive for use in the manufacture of semiconductors to the workpiece, the abnormally agglomerated particles in the abrasive can be deagglomerated as much as possible by sonicating the abrasive by ultrasonic wave before supplying the abrasive to the workpiece and, as a result, the abrasive can restore roughly the same particle diameter and particle size distribution obtained at the time of preparation by the time it reaches the workpiece. In this manner, it is possible to solve the problems of fluctuation of the polishing speed and lowering of the yield of polished products due to damages on the surface.

This invention will be described concretely below with reference to examples and comparative examples.

EXAMPLE 1

AND

COMPARATIVE EXAMPLE 1

Fumed silica was used as silica-based abrasive particles and an aqueous solution of $NH_4OH$ was used as a dispersion medium. With the use of the apparatus for preparing the abrasive shown in FIG. 2, the fumed silica was dispersed homogeneously in the aqueous solution of $NH_4OH$ to give the abrasive.

The abrasive thus prepared was measured for the particle size distribution in terms of particle diameter ($\mu$m), mass base cumulative size distribution Q3 (%), and mass base density distribution q3 (%) with the aid of a particle size distribution analyzer (Model SALS-2000-98A2:V1.01, Shimadzu Corporation). The results are shown in FIG. 3.

Figure 3:
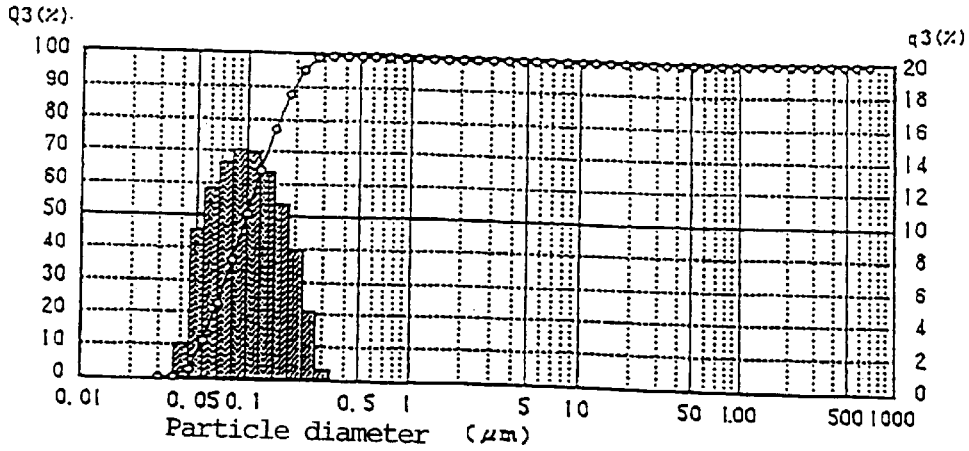
FIG. 3 is a graph showing mass base cumulative size distribution Q3 (%) or mass base density distribution q3 (%) plotted against particle size ($\mu$m) for a normal abrasive as determined by a particle size distribution analyzer.

The abrasive having the particle size distribution shown in FIG. 3 was left standing for 6 months at room temperature and the resulting abnormal abrasive was introduced into the mixing tank 8 of the preparatory apparatus shown in FIG. 2 and, with the ultrasonic wave generator 7*b* turned off, subjected to the conventional agitation consisting of propeller agitation by the agitating element 8*b* and circulation by the circulating line 8*c*. The abrasive was sampled after passage of 3, 5 and 7 minutes and measured for the particle size distribution in the aforementioned manner.

Figure 4:
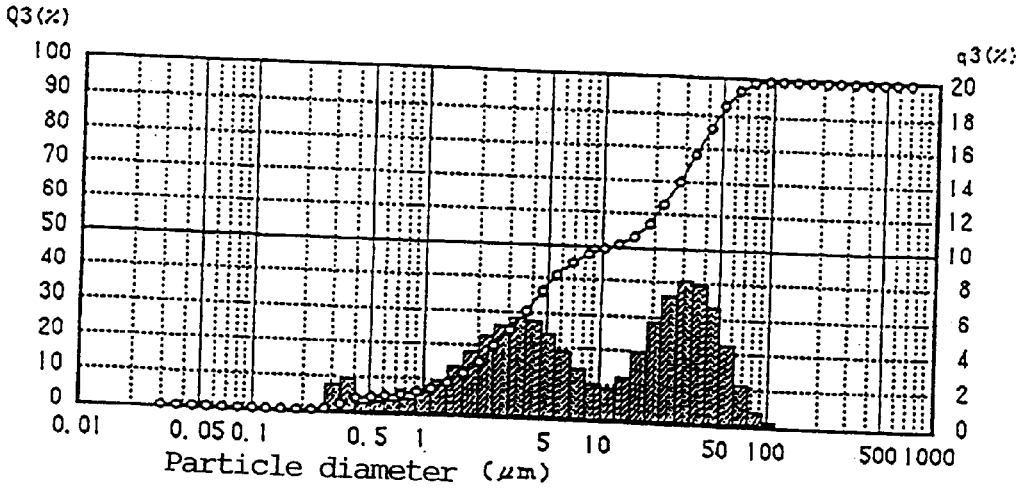
FIG. 4 is a graph, similar to FIG. 3, for an abnormal abrasive, which refers to an abrasive left as prepared for 6 months, after conventional agitation for 3 minutes.
Figure 5:
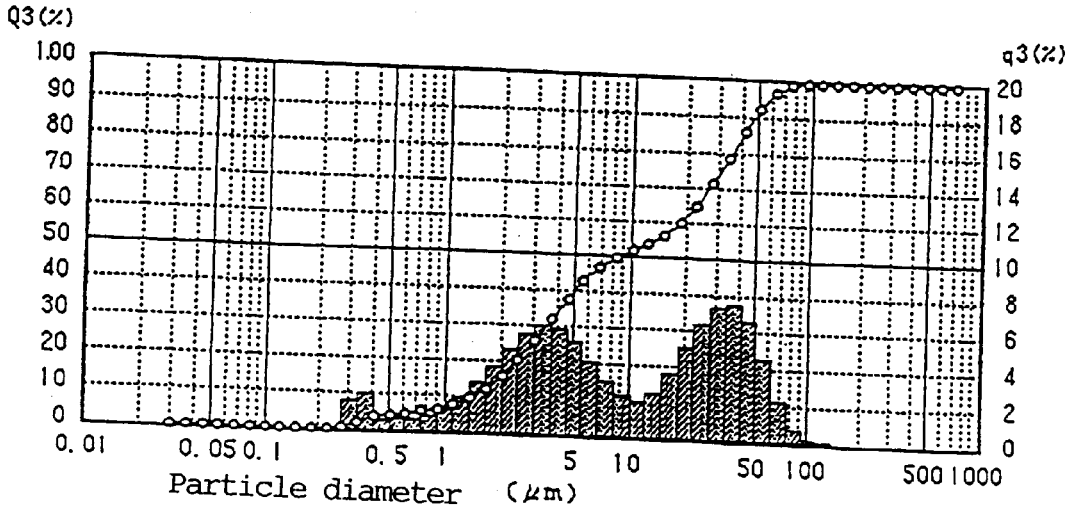
FIG. 5 is a graph, similar to FIG. 3, for the abnormal abrasive after conventional agitation for 5 minutes.
Figure 6:
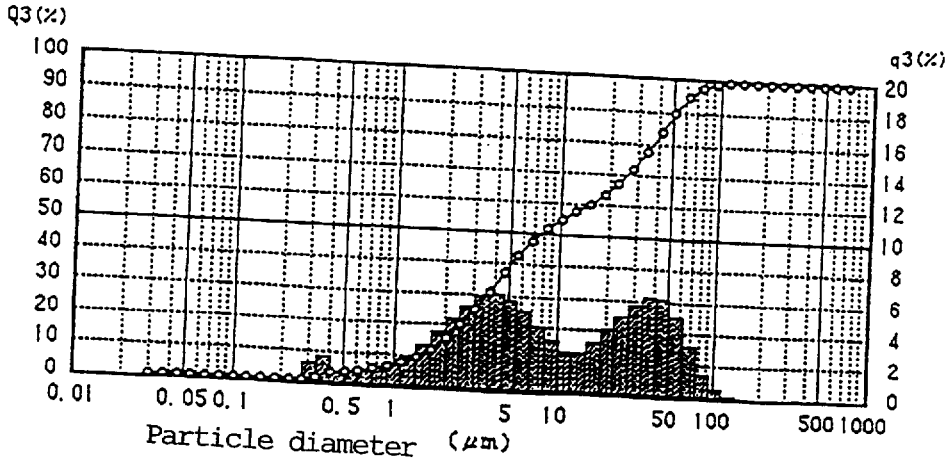
FIG. 6 is a graph, similar to FIG. 3, for the abnormal abrasive after conventional agitation for 7 minutes.
Figure 7:
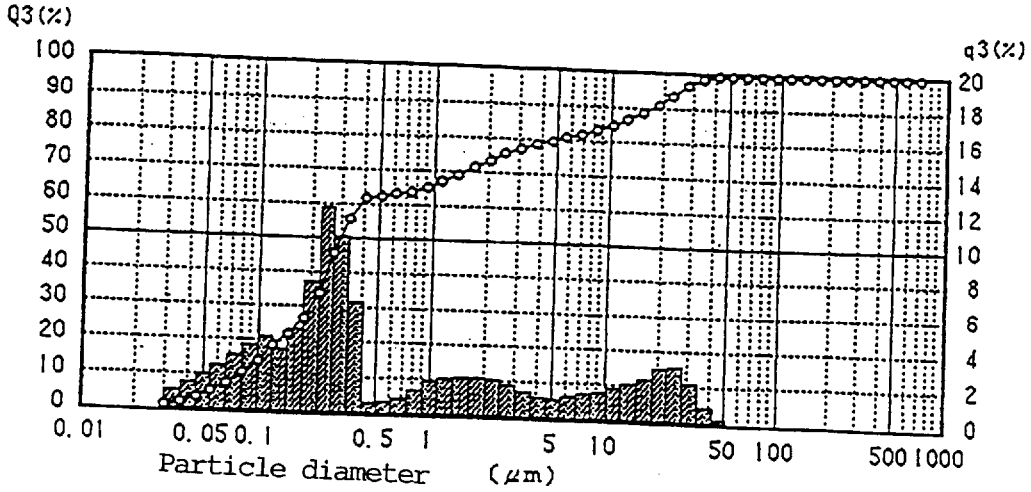
FIG. 7 is a graph, similar to FIG. 3, for the abnormal abrasive after conventional agitation together with application of ultrasonic wave for 3 minutes in accordance with this invention.

The results are shown in FIGS. 4 to 6. As is apparent from these results, the conventional agitation consisting of only propeller agitation and circulation can hardly deagglomerate the abnormally agglomerated particles with a particle diameter of 0.5 $\mu$m or more.

Next, while continuing the conventional agitation consisting of propeller agitation by the agitating element 8*b* and circulation by the circulating line 8*c*, the ultrasonic wave generator 7*b* was turned on to sonicate the abrasive directly by ultrasonic wave of a frequency of 42 kHz, and the abrasive was sampled after passage of 3, 5, 7 and 10 minutes and measured for the particle size distribution in the aforementioned manner.

Figure 8:
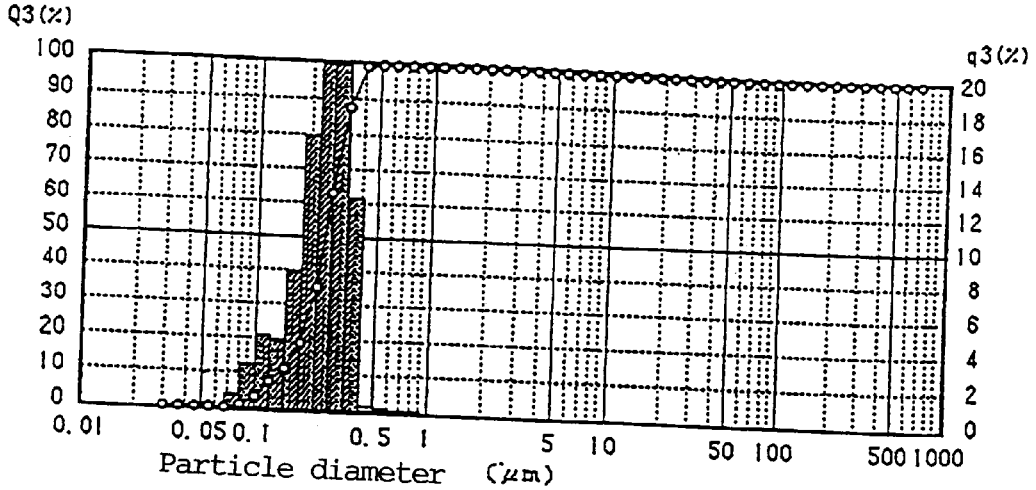
FIG. 8 is a graph, similar to FIG. 3, for the abnormal abrasive after conventional agitation together with application of ultrasonic wave for 5 minutes in accordance with this invention.
Figure 9:
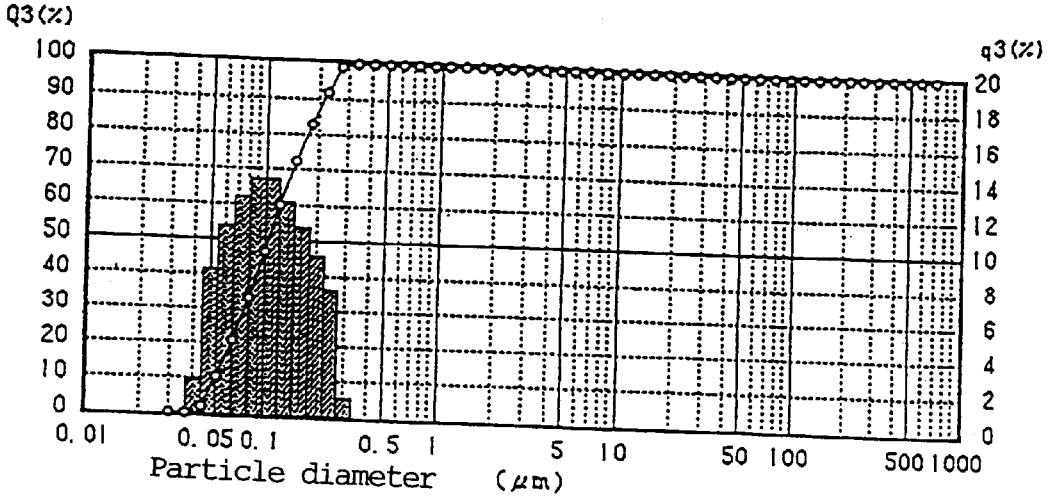
FIG. 9 is a graph, similar to FIG. 3, for the abnormal abrasive after conventional agitation together with application of ultrasonic wave for 7 minutes in accordance with this invention.
Figure 10:
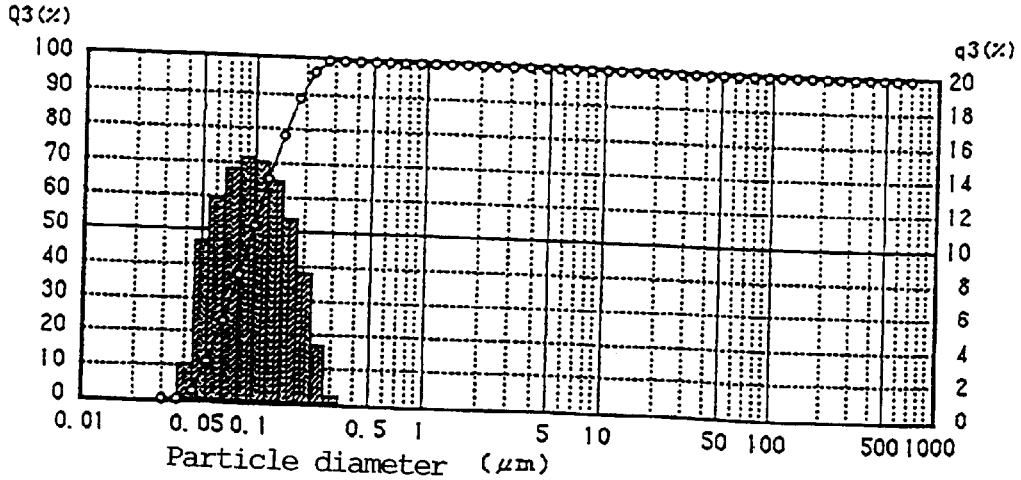
FIG. 10 is a graph, similar to FIG. 3, for the abnormal abrasive after conventional agitation together with application of ultrasonic wave for 10 minutes in accordance with this invention.

The results are shown in FIGS. 7 to 10. As is apparent from these results, with simultaneous application of ultrasonic wave to agitation according to this invention, the onset of deagglomeration of the abnormally agglomerated particles was observed distinctly after 3-minute sonication (FIG. 7) and deagglomeration of the greater part of the abnormally agglomerated particles was confirmed after 5-minute sonication (FIG. 8). The abrasive restored practically the same condition obtained at the time of preparation shown in FIG. 1 after 7-minute sonication (FIG. 9) and this condition was maintained after 10-minute sonication (FIG. 10).

EXAMPLE 2

AND

COMPARATIVE EXAMPLE 2

Fumed silica was used as silica-based abrasive particles and an aqueous solution of KOH was used as a dispersion medium. With the use of the apparatus for preparing the abrasive shown in FIG. 2, the fumed silica was dispersed homogeneously in the aqueous solution of $NH_4OH$ to give the abrasive, which was left standing for 6 months.

Next, the apparatus of FIG. 2 was adjusted to use the mixing tank 8 alone in the following test by shutting off the diluting tank 9 and a Teflon filter (product of NIHON PALL LTD.) with a pore size of 10 $\mu$m was applied as filter 10. Test lots, each consisting of 100 liters of the abrasive, were prepared and each lot was agitated by the circulating line 8*c* for 2 hours and particles larger than the standard particle diameter (10 $\mu$m) primarily composed of particles abnormally agglomerated during the 6-month storage were filtered off. The test was run with or without simultaneous sonication of the abrasive by ultrasonic wave of a frequency of 42 kHz with the aid of the ultrasonic wave generator 7*b* and the effect of the mode of agitation on the service life of the filter 10 was examined.

The effective service life of filter was evaluated by observing whether the aired pump (pump 12) for the mixing tank 8 stops or not as the filter 10 clogs.

The results are as follows: in the case of the conventional agitation without sonication of the abrasive, the first lot clogged after 30 minutes while in the case of simultaneous sonication of the abrasive with the aid of the ultrasonic wave generator 7*b* the filter 10 performed satisfactorily until after 1,730 minutes from the start or until halfway of the 15th lot.

These results prove that a filter to remove particles larger than the standard particle diameter can be used at the same time when the agitation of the abrasive is effected by a combination of conventional agitation and sonication with the aid of the ultrasonic wave generator 7*b* in accordance with this invention.

What is claimed is:

1. An apparatus for supplying an abrasive for use in the manufacture of semiconductors containing a storage tank for storing the abrasive and a supply line for guiding the abrasive from the storage tank to a nozzle for supplying the abrasive to an object to be polished, wherein a device for furnishing ultrasonic wave is provided underneath the bottom wall and/or outside the side wall of the storage tank for the indirect sonication of the abrasive or is provided inside the storage tank for the direct sonication of the abrasive.

2. The apparatus for supplying an abrasive for use in the manufacture of semiconductors described in claim 1 wherein the device for furnishing ultrasonic wave is an ultrasonic wave generator provided outside the supply line for the indirect sonication of the abrasive.

3. An apparatus for supplying an abrasive for use in the manufacture of semiconductors containing a storage tank for storing the abrasive and a supply line for guiding the abrasive from the storage tank to a nozzle for supplying the abrasive to an object to be polished, wherein a device for furnishing ultrasonic wave is provided on said storage tank or supply line for the sonication of the abrasive and wherein a filter to remove particles larger than the standard particle diameter is provided between the device for furnishing ultrasonic wave and the nozzle.

4. The apparatus for supplying an abrasive for use in the manufacture of semiconductors described in claim 1 or 3 wherein the device for furnishing ultrasonic wave is an ultrasonic wave generator provided underneath the bottom wall and/or outside the side wall of the storage tank for the indirect sonication of the abrasive.

5. The apparatus for supplying an abrasive for use in the manufacture of semiconductors described in claim 1 or 3 wherein the device for furnishing ultrasonic wave is an ultrasonic wave generator provided inside the storage tank for the direct sonication of the abrasive.

6. The apparatus for supplying an abrasive for use in the manufacture of semiconductors described in claim 1 or 3 wherein the ultrasonic wave to sonicate the abrasive by means of the device for furnishing ultrasonic wave possesses a frequency in the range from 19 kHz to 2 MHz.

7. The apparatus for supplying an abrasive for use in the manufacture of semiconductors described in claim 6 wherein the ultrasonic wave possesses a frequency in the range from 20 kHz to 100 kHz.

8. The apparatus for supplying an abrasive for use in the manufacture of semiconductors described in claims 1 or 3 wherein the abrasive sonicated by ultrasonic wave is with a high concentration requiring proper dilution immediately before use.

9. A process for supplying an abrasive for use in the manufacture of semiconductors comprising sonicating the abrasive by ultrasonic wave with a device for furnishing ultrasonic wave provided underneath the bottom wall and/or outside the side wall of the storage tank for the indirect sonication of the abrasive or provided inside the storage tank for the direct sonication of the abrasive before supplying said abrasive to an object to be polished.

10. A process for supplying an abrasive for use in the manufacture of semiconductors comprising sonicating the abrasive by ultrasonic wave before supplying said abrasive to an object to be polished wherein the abrasive sonicated by ultrasonic wave is filtered to remove particles larger than the standard particle diameter and supplied to the object to be polished.

11. The apparatus for supplying an abrasive for use in the manufacture of semiconductors described in claims 9, or 10 wherein the ultrasonic wave possesses a frequency in the range from 19 kHz to 2 MHz.

12. The process for supplying an abrasive for use in the manufacture of semiconductors described in claim 11 wherein the ultrasonic wave possesses a frequency in the range from 20 kHz to 100 kHz.

13. The process for supplying an abrasive for use in the manufacture of semiconductors described in claims 9 or 10 wherein the abrasive sonicated by ultrasonic wave is with a high concentration requiring proper dilution immediately before use.

* * * * *